US007954168B2

(12) United States Patent
Cutlip et al.

(10) Patent No.: US 7,954,168 B2
(45) Date of Patent: Jun. 7, 2011

(54) GARMENT SLEEVE WITH KNUCKLE PROTECTOR AND THUMB APERTURE

(75) Inventors: Kevin P. Cutlip, Ponce Inlet, FL (US); Jodi Tomlinson, Ponce Inlet, FL (US)

(73) Assignee: GX, Inc., Ponce Inlet, FL (US)

( * ) Notice: Subject to any disclaimer, the term of this patent is extended or adjusted under 35 U.S.C. 154(b) by 1055 days.

(21) Appl. No.: 11/786,733

(22) Filed: Apr. 13, 2007

(65) Prior Publication Data

US 2008/0250539 A1 Oct. 16, 2008

(51) Int. Cl.
*A41D 13/08* (2006.01)

(52) U.S. Cl. ..... 2/16; 2/162

(58) Field of Classification Search ..... 2/21, 917, 2/161.1, 161.6, 59, 162, 16, 170; D29/116.2, D29/116.3

See application file for complete search history.

(56) References Cited

U.S. PATENT DOCUMENTS

| | | | | | |
|---|---|---|---|---|---|
| 2,904,792 | A | | 9/1959 | Elliott | |
| 2,924,458 | A | * | 2/1960 | Barry | 473/62 |
| 3,881,197 | A | * | 5/1975 | Andrews | 2/161.8 |
| 3,882,548 | A | * | 5/1975 | Shinagawa et al. | 2/20 |
| 4,137,572 | A | * | 2/1979 | Jansson et al. | 2/16 |
| 4,497,073 | A | * | 2/1985 | Deutsch | 2/20 |
| 4,689,828 | A | * | 9/1987 | Brewer | 2/21 |
| 4,815,147 | A | * | 3/1989 | Gazzano et al. | 2/161.1 |
| 4,958,384 | A | * | 9/1990 | McCrane | 2/161.6 |
| 5,295,269 | A | * | 3/1994 | Ballard | 2/18 |
| 5,313,667 | A | * | 5/1994 | Levine | 2/16 |
| 5,345,609 | A | * | 9/1994 | Fabry et al. | 2/20 |
| 5,781,928 | A | * | 7/1998 | Avila | 2/16 |
| 5,794,265 | A | | 8/1998 | Reich | |
| 5,878,435 | A | | 3/1999 | Kast et al. | |
| 5,884,329 | A | * | 3/1999 | Goldsmith et al. | 2/16 |
| 5,913,408 | A | | 6/1999 | Shanahan | |
| 6,076,189 | A | | 6/2000 | Christman et al. | |
| 6,119,267 | A | * | 9/2000 | Pozzi | 2/20 |
| 6,154,882 | A | * | 12/2000 | Ullman | 2/20 |
| 6,249,916 | B1 | | 6/2001 | Mellon et al. | |
| 6,253,381 | B1 | | 7/2001 | Kelley | |
| 6,418,561 | B1 | | 7/2002 | Gregory | |
| 6,430,744 | B1 | | 8/2002 | Redman et al. | |
| 6,443,921 | B1 | | 9/2002 | Kaplan | |
| 6,725,466 | B2 | * | 4/2004 | Hochmuth | 2/161.1 |
| 6,839,911 | B1 | | 1/2005 | Mathews | |
| 7,275,268 | B2 | * | 10/2007 | Gait | 2/161.1 |
| D595,458 | S | * | 6/2009 | Kleinert | D29/116.2 |
| 7,694,351 | B2 | * | 4/2010 | Gait | 2/161.1 |
| 2006/0276735 | A1 | * | 12/2006 | Phelen et al. | 602/21 |
| 2007/0021700 | A1 | * | 1/2007 | Liebowitz | 602/22 |

* cited by examiner

*Primary Examiner* — Katherine Moran
*Assistant Examiner* — Richale L Quinn
(74) *Attorney, Agent, or Firm* — Paul S. Rooy PA

(57) ABSTRACT

A garment sleeve with knuckle protector and thumb aperture. A shield having knuckle thimbles attached to a shield base, is attached either to a sleeve inner surface or a sleeve outer surface. If the former, the sleeve incorporates sleeve thimble apertures through which the knuckle thimbles extend. Indicia may be inscribed on the knuckle thimbles for aesthetic reasons. Each knuckle thimble may incorporate a thimble void sized to admit a human knuckle on a side of the shield base opposite a thimble dome. A thumb aperture is located through the sleeve such that when the thumb of a wearer of the sleeve extends through the thumb aperture, the wearer's knuckles are disposed beneath, and protected by, the knuckle thimbles.

12 Claims, 4 Drawing Sheets

Fig. 8
PRIOR ART
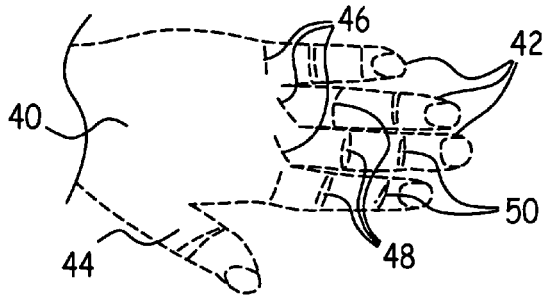
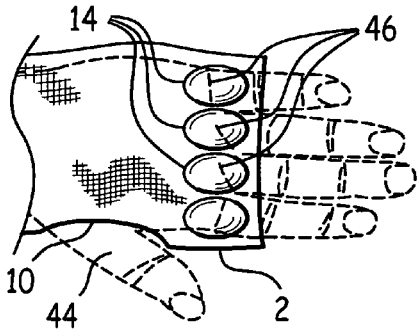
Fig. 9
Fig. 10
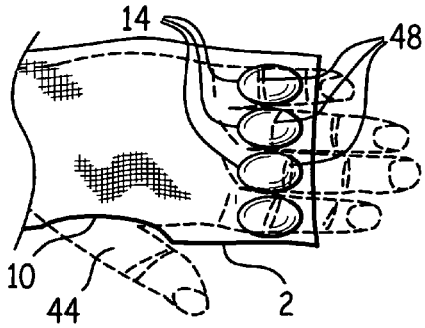
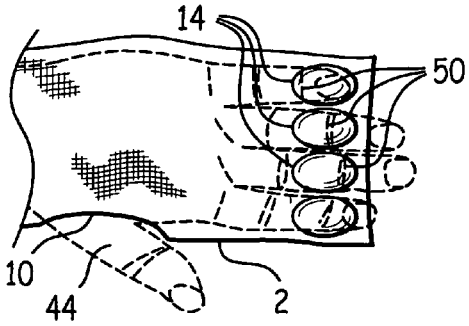
Fig. 11

GARMENT SLEEVE WITH KNUCKLE PROTECTOR AND THUMB APERTURE

BACKGROUND OF THE INVENTION

1. Field of the Invention

This invention relates to garments, and in particular to a garment sleeve with knuckle protector and thumb aperture.

2. Background of the Invention

Knuckles are some of the least protected body parts. Skinning one's knuckles is not an experience most humans enjoy, and protection of knuckles would avoid this type of injury. Accordingly, it would be desirable to provide a garment capable of affording such protection to the wearer.

Existing Designs

A number of patents have issued for thermal protection of the forearm, which taught a thumb aperture to hold a garment sleeve over the section of forearm sought to be protected from the elements. U.S. Pat. Nos. 6,430,744, 5,913,408, and 2,904,792, granted to Redman et al., Shanahan, and Elliott respectively, are representative of these.

While these designs afforded some protection against cold, no provision for knuckle protection was taught, other than the abradable textile from which the garment itself was made. Thus, it would be desirable to provide a garment sleeve with knuckle protector and thumb aperture which is capable of protecting the knuckles of the wearer from injury, as well as having provision to maintain the garment sleeve in position so as to permit the knuckle protector to accomplish its function.

SUMMARY OF THE INVENTION

Accordingly, it is an object of the present invention to provide a garment sleeve with knuckle protector and thumb aperture which protects the knuckles of an individual wearing the garment sleeve. Design features allowing this object to be accomplished include a plurality of knuckle thimbles attached to a sleeve, and a thumb aperture in the sleeve, positioned so as to co-extend with the knuckles of the wearer. Benefits associated with the accomplishment of this object include increased knuckle protection against injury, and attendant safety.

It is another object of the present invention to provide a garment sleeve with knuckle protector and thumb aperture which automatically locates knuckle protection over the knuckles of the wearer. Design features allowing this object to be accomplished include a plurality of knuckle thimbles attached to a sleeve, and a thumb aperture in the sleeve positioned such that when the wearer's thumb extends through the thumb aperture, the knuckle thimbles are positioned over the wearer's knuckles. Benefits associated with the accomplishment of this object include knuckle protection against injury, and attendant safety.

It is another object of the present invention to provide a garment sleeve with knuckle protector and thumb aperture which is aesthetically pleasing. Design features allowing this object to be accomplished include a plurality of knuckle thimbles of pleasing color, and/or having indicia on them. Benefits associated with the accomplishment of this object include a sleeve knuckle which is both functional to help avoid knuckle injury, and pleasing to the eye.

It is still another object of this invention to provide a garment sleeve with knuckle protector and thumb aperture which is inexpensive to produce. Design features enabling the accomplishment of this object include use of existing-technology sleeves and molded shields, which can be produced in large quantities at a low unit cost. Advantages associated with the realization of this object include reduced cost, and consequent increased affordability.

BRIEF DESCRIPTION OF THE DRAWINGS

The invention, together with the other objects, features, aspects and advantages thereof will be more clearly understood from the following in conjunction with the accompanying drawings.

Three sheets of drawings are provided. Sheet one contains FIGS. 1, 2 and 3. Sheet two contains FIGS. 4, 5 and 6. Sheet three contains FIG. 7.

FIG. 8 is a top view of a hand.

FIG. 9 is a top view of a hand inside a sleeve, with the thumb aperture located through the sleeve so as to position the knuckle thimbles over the metacarpal phalangeal joints.

FIG. 10 is a top view of a hand inside a sleeve, with the thumb aperture located through the sleeve so as to position the knuckle thimbles over the proximal phalangeal joints.

FIG. 11 is a top view of a hand inside a sleeve, with the thumb aperture located through the sleeve so as to position the knuckle thimbles over the distal phalangeal joints.

DETAILED DESCRIPTION OF THE PREFERRED EMBODIMENT

Figure 1:
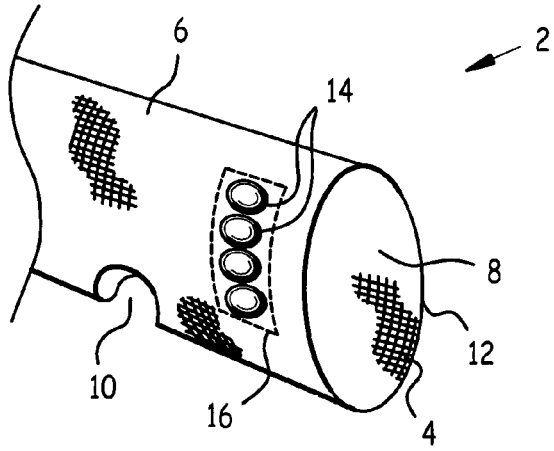
FIG. 1 is a side elevated isometric view of a garment sleeve with knuckle protector and thumb aperture.

FIG. 1 is a side elevated isometric view of a garment sleeve with knuckle protector and thumb aperture, which comprises shield 18 attached to sleeve 2. As may be observed in FIG. 4, a side elevated isometric view of shield 18, shield 18 comprises a plurality of knuckle thimbles 14 attached to shield base 24.

Figure 2:
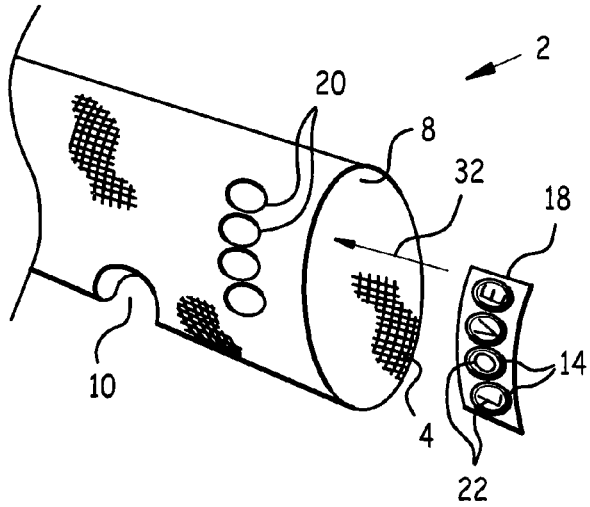
FIG. 2 is a side elevated isometric view of a garment sleeve with knuckle protector and thumb aperture, with a shield about to be attached to sleeve inner surface 4.

FIG. 2 is a side elevated isometric view of a garment sleeve with knuckle protector and thumb aperture with a shield 18 about to be installed on sleeve inner surface 4, as indicated by arrow 32. Shield 18 may be installed on sleeve inner surface 4 as depicted in FIGS. 1, 2, and 6, or on sleeve outer surface 6 as depicted in FIG. 3.

Where shield 18 is installed on sleeve inner surface 4, sleeve 2 comprises a sleeve thimble aperture 20 corresponding to each knuckle thimble 14. Shield 18 is inserted into arm hole 8 at sleeve distal end 12, and placed such that each knuckle thimble 14 extends through a corresponding sleeve thimble aperture 20. Shield 18 may be secured in this position by means of adhesive, stitching 16, hook and loop material, and/or any other appropriate means.

Thumb aperture 10 is sized and placed on sleeve 2 such as to admit the wearer's thumb, and when the wearer's thumb is disposed through thumb aperture 10, the wearer's knuckles are located beneath, and protected by, knuckle thimbles 14.

Figure 3:
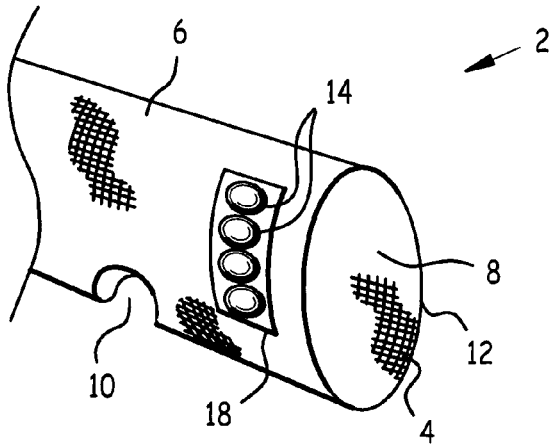
FIG. 3 is a side elevated isometric view of a garment sleeve with knuckle protector and thumb aperture, with a shield attached to sleeve outer surface 6.
Figure 6:
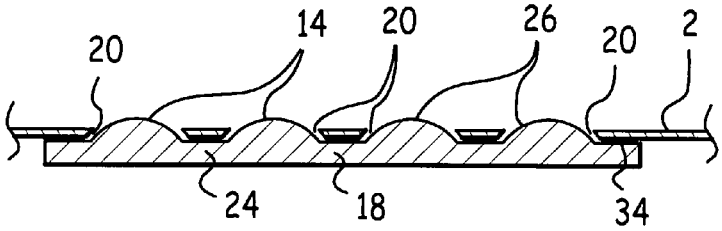
FIG. 6 is a side cross-sectional view of an alternate embodiment shield.

As previously mentioned, shield 18 may be attached either to sleeve outer surface 6 (as depicted in FIGS. 1, 2 and 6), or sleeve inner surface 4, as depicted in FIG. 3. FIG. 3 is a side elevated isometric view of a garment sleeve with knuckle protector and thumb aperture, with a shield 18 attached to sleeve outer surface 6. If shield 18 is to be attached to sleeve outer surface 6 as depicted in FIG. 3, shield 18 is emplaced on sleeve outer surface 6 such that when a wearer's thumb extends through thumb aperture 10, each of the wearer's knuckles is disposed beneath, and protected by, a corresponding knuckle thimble 14. Shield 18 may be attached to sleeve outer surface 6 by any appropriate means, including but not limited to adhesive, stitching 16, hook and loop material, etc.

Figure 4:
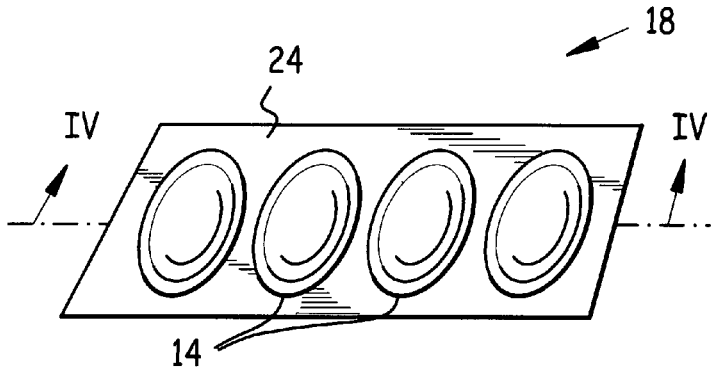
FIG. 4 is a side elevated isometric view of a shield.

FIG. 4 is a side elevated isometric view of shield 18. Shield 18 comprises a plurality of knuckle thimbles 14 attached to, or integrally constructed with, shield base 24. In the preferred embodiment, there were four knuckle thimbles 14 attached to, or built into, shield base 24, one for each human finger knuckle at the metacarpal phalangeal joint (the joint at the base of each finger connecting the metacarpal and the proximal phalange). It is intended to fall within the scope of this disclosure, however, that knuckle thimbles 14 may also be located over other finger knuckles, including but not limited to the proximal interphalangeal joint (the joint in each finger connecting the proximal and middle phalanges), and/or the distal interphalangeal joint (the joint in each finger connecting the middle and distal phalanges).

Figure 5:
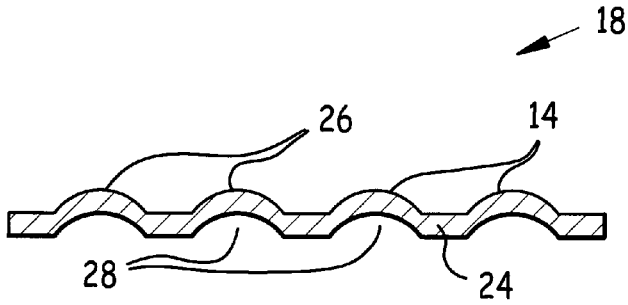
FIG. 5 is a side cross-sectional view of a shield.

FIG. 5 is a side cross-sectional view of shield 18 taken at section IV-IV of FIG. 4. Each knuckle thimble 14 comprises a thimble dome 26. In the embodiment garment sleeve with knuckle protector and thumb aperture depicted in FIGS. 1, 2 and 6, each sleeve thimble aperture 20 was sized to admit a thimble dome 26. In the embodiment shield depicted in FIG. 5, each knuckle thimble 14 comprised thimble dome 26, and each knuckle thimble 14 comprised a thimble void 28 sized to admit a human knuckle.

As may be observed in FIG. 5, thimble domes 26 are disposed on one surface of shield base 24, and a corresponding thimble void 28 is disposed directly opposed on an opposite surface of shield base 24. Each thimble void 28 nests within a corresponding thimble dome 26.

FIG. 6 is a side cross-sectional view of an alternate embodiment shield 18 wherein knuckle thimbles 14 did not comprise corresponding thimble voids 28. Shield 18 is attached to sleeve 2 by means of adhesive 34. Each thimble dome 26 extends through a corresponding sleeve thimble aperture 20.

As may be observed in FIG. 2, indicia 14 may be inscribed on one or more knuckle thimbles 14 to enhance the aesthetic appeal of the instant garment sleeve with knuckle protector and thumb aperture. In addition, shield 18, and/or knuckle thimbles 14 individually, may be colored or fabricated of colored material, in aesthetically pleasing colors.

Figure 7:
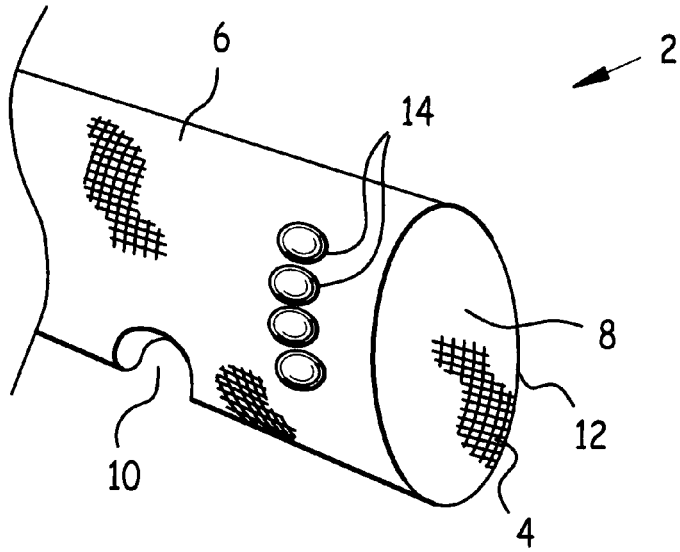
FIG. 7 is a side elevated isometric view of an alternate embodiment garment sleeve with knuckle protector and thumb aperture with individual knuckle thimbles.

FIG. 7 is a side elevated isometric view of an alternate embodiment garment sleeve with knuckle protector and thumb aperture with individual knuckle thimbles 14. Individual knuckle thimbles 14 are attached directly to sleeve 2 by any appropriate means, including adhesive, stitching, hook-and-loop material, etc. Thumb aperture 10 is emplaced so that when the thumb of a wearer of garment sleeve 2 extends through thumb aperture 10, the wearer's knuckles are disposed beneath, and are protected by, knuckle thimbles 14.

In the preferred embodiment, sleeve 2 was a conventional garment sleeve made of textile, leather, canvas, synthetic, etc. Shield 18 was made of Kevlar, nylon, metal, leather, wood, molded plastic, or other appropriate material.

FIG. 8 is a top view of hand 40. As may be observed in this figure, hand 40 comprises fingers 42 and thumb 44. Each finger 42 comprises a metacarpal phalangeal joint 46, a proximal phalangeal joint 48, and a distal phalangeal joint 50.

FIG. 9 is a top view of hand 40 inside sleeve 2, with thumb aperture 10 located through sleeve 2 so as to position knuckle thimbles 14 over metacarpal phalangeal joints 46.

FIG. 10 is a top view of hand 40 inside sleeve 2, with thumb aperture 10 located through sleeve 2 so as to position knuckle thimbles 14 over proximal phalangeal joints 48.

FIG. 11 is a top view of hand 40 inside sleeve 2, with thumb aperture 14 located through sleeve 2 so as to position knuckle thimbles 14 over distal phalangeal joints 50.

While a preferred embodiment of the invention has been illustrated herein, it is to be understood that changes and variations may be made by those skilled in the art without departing from the spirit of the appending claims.

DRAWING ITEM INDEX

2 sleeve
4 sleeve inner surface
6 sleeve outer surface
8 armhole
10 thumb aperture
12 sleeve distal end
14 knuckle thimble
16 stitching
18 shield
20 sleeve thimble aperture
22 indicia
24 shield base
26 thimble dome
28 thimble void
34 adhesive
40 hand
42 finger
44 thumb
46 metacarpal phalangeal joint
48 proximal phalangeal joint
50 distal phalangeal joint

We claim:

1. A garment sleeve with knuckle protector and thumb aperture comprising a garment sleeve and a shield;

said sleeve comprising a sleeve outer surface and a sleeve inner surface, a sleeve distal end, and a single arm hole through which an interior of said sleeve communicates with an exterior of said sleeve and through which all of the fingers on a user's hand can pass, said single arm hole being disposed at said sleeve distal end;

said shield comprising a plurality of knuckle thimbles on a shield base, said shield base being attached to said sleeve, said shield being disposed immediately adjacent said single arm hole;

said sleeve further comprising a sleeve thimble aperture corresponding to each said knuckle thimble, and a sleeve inner surface, each said sleeve thimble aperture being sized to admit one said knuckle thimble, said shield being attached to said sleeve inner surface, and each said knuckle thimble extending through a corresponding said sleeve thimble aperture.

2. The garment sleeve with knuckle protector and thumb aperture of claim 1 wherein said sleeve further comprises a thumb aperture sized to admit a human thumb, said thumb aperture being disposed farther away from said arm hole than said shield, whereby when a thumb of a wearer of said garment sleeve extends through said thumb aperture, said wearer's knuckles are disposed beneath, and are protected by, said knuckle thimbles.

3. The garment sleeve with knuckle protector and thumb aperture of claim 2 wherein at least one said knuckle thimble comprises indicia, whereby aesthetic appeal of said shield may be enhanced.

4. The garment sleeve with knuckle protector and thumb aperture of claim 2 wherein each said knuckle thimble comprises a thimble dome on one surface of said shield base and a corresponding thimble void directly opposed on an opposite surface of said shield base, said thimble void nesting within said thimble dome.

5. The garment sleeve with knuckle protector and thumb aperture of claim 2 wherein said shield is attached to said sleeve by means of adhesive.

6. The garment sleeve with knuckle protector and thumb aperture of claim 2 wherein said shield is attached to said sleeve by means of stitching.

7. A garment sleeve with knuckle protector and thumb aperture comprising a shield attached to a sleeve, said sleeve comprising a sleeve outer surface, a sleeve inner surface, a sleeve distal end, and a single arm hole through which an interior of said sleeve communicates with an exterior of said sleeve and through which all of the fingers on a users's hand can pass, said single arm hole being disposed at said distal end, said shield comprising a plurality of knuckle thimbles attached to a shield base, successive said knuckle thimbles being spaced apart a distance corresponding to a distance between adjacent human knuckles, said shield being disposed immediately adjacent said single arm hole said sleeve further comprising a thumb aperture sized to admit a human thumb, said thumb aperture being disposed farther away from said arm hole end than said knuckle thimbles, whereby when the thumb of a wearer of said garment sleeve extends through said thumb aperture said wearer's knuckles are disposed beneath, and are protected by, said knuckle thimbles, said sleeve further comprising a sleeve thimble aperture corresponding to each said knuckle thimble, each said sleeve thimble aperture being sized to admit one said knuckle thimble, said shield being attached to said sleeve inner surface, each said knuckle thimble extending through a corresponding said sleeve thimble aperture.

8. The garment sleeve with knuckle protector and thumb aperture of claim 7 wherein each said knuckle thimble comprises a thimble dome on one surface of said shield base and a corresponding thimble void directly opposed on an opposite surface of said shield base, said thimble void nesting within said thimble dome.

9. The garment sleeve with knuckle protector and thumb aperture of claim 7 wherein at least one said knuckle thimble comprises indicia, whereby aesthetic appeal of said shield may be enhanced.

10. A garment sleeve with knuckle protector and thumb aperture comprising a shield attached to a sleeve, said shield comprising a plurality of knuckle thimbles attached to a base, successive said knuckle thimbles being spaced apart a distance corresponding to a distance between adjacent human knuckles, said sleeve comprising a sleeve outer surface, a sleeve inner surface, a sleeve distal end, a sleeve thimble aperture corresponding to each said knuckle thimble, and a single arm hole through which an interior of said garment sleeve communicates with an exterior of said garment sleeve and through which all of the fingers on a user's hand can pass, said single arm hole being disposed at said garment sleeve distal end, said shield being attached to said sleeve inner surface, each said sleeve thimble aperture being sized to admit one said knuckle thimble, each said knuckle thimble extending from an interior of said sleeve to an exterior of said sleeve through a corresponding said sleeve thimble aperture.

11. The garment sleeve with knuckle protector and thumb aperture of claim 10 wherein said sleeve further comprises a thumb aperture sized to admit a human thumb, said thumb aperture being disposed farther away from said arm hole end than said knuckle thimbles, whereby when a thumb of a wearer of said garment sleeve extends through said thumb aperture, said wearer's knuckles are disposed beneath, and are protected by, said knuckle thimbles.

12. The garment sleeve with knuckle protector and thumb aperture of claim 11 further comprising indicia on at least one said knuckle thimble.

* * * * *